United States Patent [19]

Livingston

[11] Patent Number: 4,937,533

[45] Date of Patent: Jun. 26, 1990

[54] DEFORMABLE DIPLEXER FILTER SIGNAL COUPLING ELEMENT APPARATUS

[75] Inventor: Robert M. Livingston, Dallas, Tex.

[73] Assignee: Rockwell International Corporation, El Segundo, Calif.

[21] Appl. No.: 395,117

[22] Filed: Aug. 16, 1989

[51] Int. Cl.[5] ..... H01P 1/213

[52] U.S. Cl. ..... 333/126; 333/134; 333/203; 333/235

[58] Field of Search ..... 333/125, 126, 129, 132, 333/134, 135, 203, 209, 231, 232, 235

[56] References Cited

U.S. PATENT DOCUMENTS

| | | | |
|---|---|---|---|
| 2,516,056 | 7/1950 | Keizer | 333/203 |
| 4,121,181 | 10/1978 | Nishikawa et al. | 333/134 X |
| 4,166,256 | 8/1979 | Shishido | 333/209 X |

FOREIGN PATENT DOCUMENTS

| | | | |
|---|---|---|---|
| 3028295 | 2/1982 | Fed. Rep. of Germany | 333/134 |

*Primary Examiner*—Paul Gensler

*Attorney, Agent, or Firm*—Bruce C. Lutz; V. Lawrence Sewell; H. Fredrick Hamann

[57] ABSTRACT

A deformable or flexible diplexer element provides a common input to two separate bandpass filter arrays. The construction of the element and the associated diplexer filter containers are designed such that the average distance between each end of the element and its associated resonator can be easily adjusted to optimize coupling therebetween. With the individual adjustment and associated variable coupling, the filter responses are individually optimized to the appropriate frequencies.

6 Claims, 2 Drawing Sheets

DEFORMABLE DIPLEXER FILTER SIGNAL COUPLING ELEMENT APPARATUS

THE INVENTION

The present invention is generally directed to electronics and more specifically to electronic filters. Even more specifically, the invention is directed towards a diplexer coupling element for use in a diplexer filter arrangement.

BACKGROUND

While diplexer coupling elements have appeared in the prior art in various forms, they have lacked the simplicity of the present device. One popular approach in the prior art, is to use a piece of coaxial cable from the common input point to a separate coupling probe or loop. The coaxial cable is configured in substantially one-quarter wavelength of the frequency to be coupled while the coupling actually takes place between the loop or probe and the first resonator element in the filtering device. The adjustment of the loop or probe for coupling with the resonator element was difficult to optimize.

The present invention overcomes deficiencies of the prior art by combining several functions of the prior art into a unitary device which acts as an input signal dividing means, a transmission medium, and a phase adjusting and coupling means. The design is such that the element can be deformed to adjust the average or effective distance between the element and the nearest associated resonator means to optimize the coupling and thus, the tuning and efficiency of the filter apparatus.

It is accordingly an object of the present invention to provide an improved and more cost effective diplexer coupling device.

Other objects and advantages of the present invention will be apparent from a reading of the specification and appended claims in conjunction with the drawings wherein:

DETAILED DESCRIPTION

Figure 1:
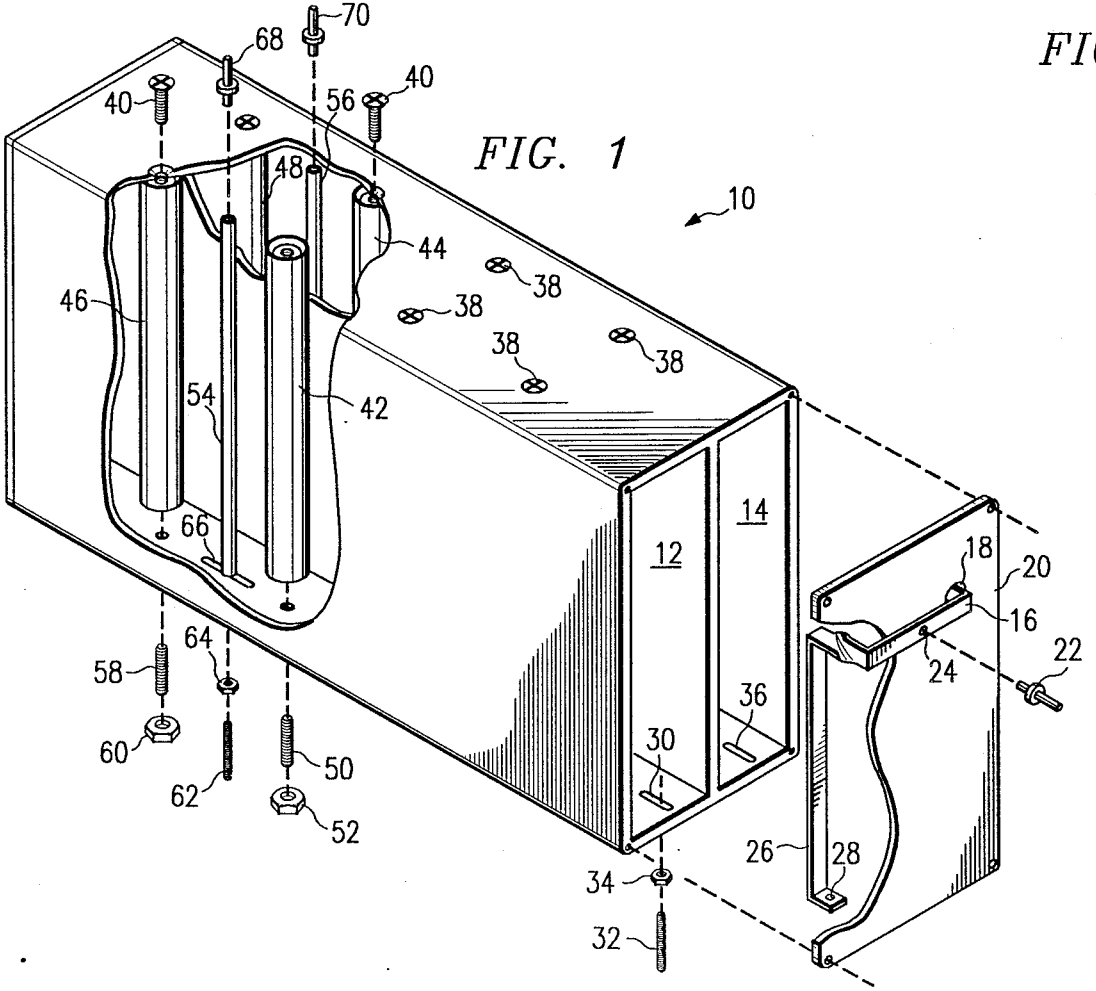
FIG. 1 is an isometric cutaway drawing of the diplexer element in combination with the entire diplexing device including resonator elements and associated cavity.

A container generally designated as 10 is shown in FIG. 1 having a first cavity generally represented as 12 and a second cavity represented as 14. The two cavities 12 and 14 are completely separate except for the fact that a diplexing element designated as 16 contains legs extending through openings 18 in a cover plate 20 so that any signals which might be applied to the diplexer coupling element 16 via an input terminal or jack 22 which is connected to an opening 24 in the diplexer coupling element 16 are directed to the cavities 12 and 14. At the bottom of a leg 26 of diplexer coupling element 16, there is an opening 28. When the cover 20 is attached to the box 10, the hole 28 is aligned with a slot

30 in the base of cavity 12. A screw or other threaded fastening means 32 passes through slot 30 to the opening 28 and is clamped in place via a nut or attachment means 34. A similar mechanism would be used for a slot 36 in cavity 14 and the other leg, which is not shown, of diplexer element 16. On the top surface of container 10, there are shown a plurality of openings containing screws 38. These screws are similar to a screw 40 used to hold resonator element 44 in place. Resonator elements are shown in a cutaway and are designated as 42 and 44. Other resonator elements are not shown in the figure but would be attached adjacent the openings shown as having screws 38. In addition to the resonator elements, there are reject elements which are given designations of 46 and 48. The resonator elements are constructed in a comb-line type filter. Each of the resonator elements is typically in the neighborhood of one-quarter wavelength long of the frequency to be bandpass filtered and a further adjustment comprising a threaded element such as 50 and its clamping nut 52 are used to alter the capacitive effect between the resonator element 42 and the container 10 such that the effective electrical length of the resonator element is exactly one-quarter wavelength of the frequency to be bandpass filtered. Although the resonators illustrated in this disclosure are shown to be mechanically approximately one-quarter wavelength long, such resonators can be considerably shorter, if so desired. In some embodiments, the mechanical length of the resonator is even less than one-eighth wavelength. In such an instance, the size of the capacitive element would need to be much larger in order to provide the adjustment necessary to insure that the electrical length equals one-quarter wavelength. Coupling means are designated as 54 and 56 and provide the output when the input signal is supplied at jack 22 and provide the input when the output signal is supplied to jack 22. For a separate but similar frequency, coupling element 56 interacts with resonator element 44 and the other resonator elements in cavity 14 to pass signals between jack 22 and the coupling element 56. The reject elements 46 and 48 are adjusted in frequency via a similar threaded element 58 and locking device 60 in a manner similar to that of the resonator 42. The reject element 46 is tuned to a frequency somewhat different from one-quarter wavelength of the bandpass frequency to be filtered to cause an absorption of the major interfering harmonic frequency. The threaded device 62 and locking means 64 interacts through an opening 66 in the base of cavity 12 of container 10 to adjust the average distance between coupling element 54 and resonator 42 for optimum coupling efficiency. A jack 68 provides the electrical connection means to the outside environment so that signals which are applied at either one of 22 and 68 of a frequency in accordance with the resonant settings of the resonators in cavity 12 will pass from one to the other. A similar jack 70 which is attached to coupling element 56 performs the same function for signals which correspond to the resonant setting of the resonators within cavity 14. Although not shown, there would be capacitive adjusting devices such as 50 and 58 illustrated for the two elements 44 and 48 as well as for the remaining resonator elements in both cavities 12 and 14. Again, although not shown, there would be attaching devices to pass through the openings in cover 20 to attach cover 20 to the end of container 10.

Figure 2:
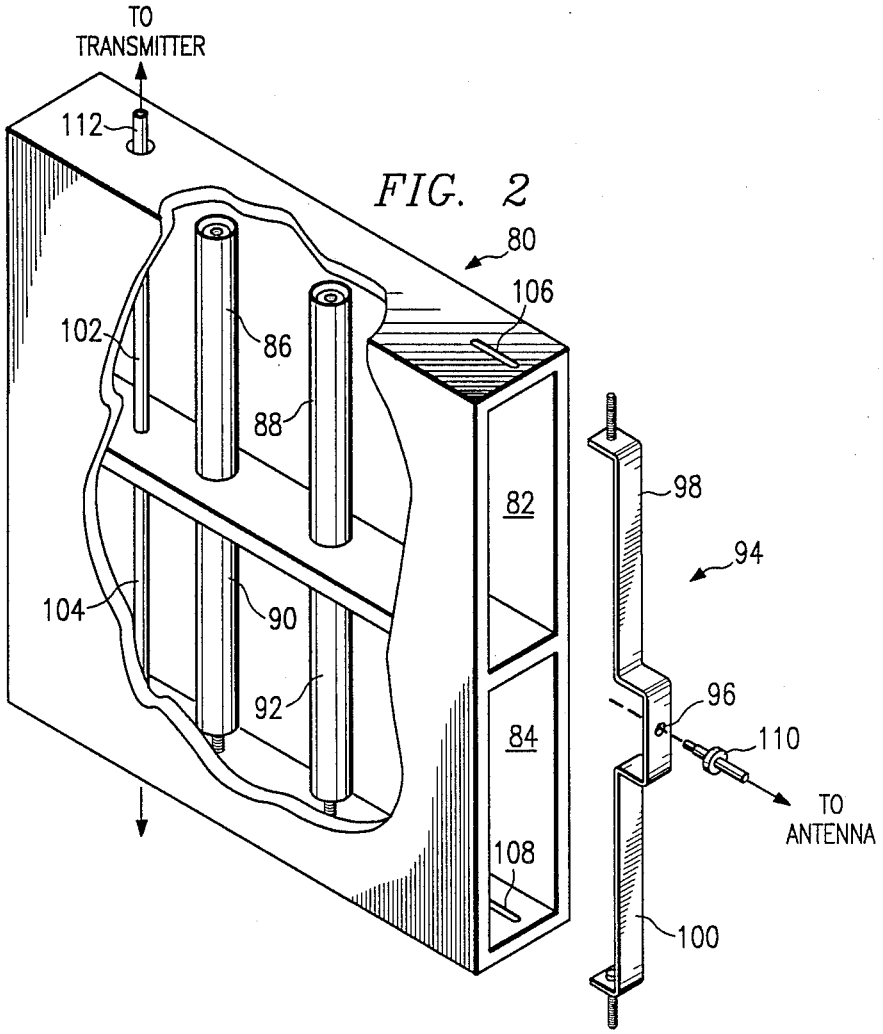
FIG. 2 is a less detailed representation of a different construction of the diplexer filter apparatus with an accordingly differently shaped diplexer coupling element.

In FIG. 2 a container 80 has two cavity openings 82 and 84 situated one above the other. Within a cutout is shown resonator elements 86 and 88 in cavity 82 and resonator elements 90 and 92 in cavity 84. A diplexer element generally designated as 94 has a common input opening 96, and legs 98 and 100 where leg 98 couples to the resonator 88 within opening 82 and leg 100 couples to resonator 92 within cavity 84. Resonator 86 is coupled to coupling device 102 while resonator 90 is coupled to coupling device 104. The leg 98 is adjusted at a position within a slot 106 while leg 100 is adjusted to a position within slot 108. Although not shown, there would be a cover plate similar to cover 20 of FIG. 1 to enclose the cavities 82 and 84 of container 80. A jack or terminal means 110 connects to opening 96 of diplexing element 94 so that if the signals of concern correspond with the tuning of the resonators within cavity 80, signals will be passed from a signal jack or terminal 112 to jack 110 or vice versa.

Figure 3:
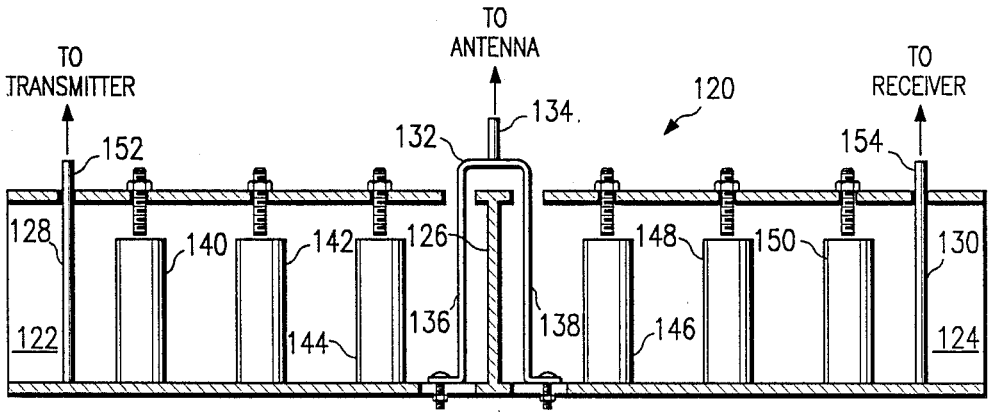
FIG. 3 is a side view of a further embodiment of the diplexer device with an illustration of the design of the diplexer coupling element in such a configuration.

In FIG. 3 a container generally shown as 120 has a cavity 122 at one end and a cavity 124 at the other end and the two cavities have a common wall 126. A first coupling means 128 is shown in cavity 122 while a second coupling means 130 is shown in cavity 124. A common diplexing element 132 is illustrated with a common jack or terminal 134. The diplexing element 132 has legs 136 and 138. Between coupling element 128 and the leg 136 are illustrated three resonators 140, 142, and 144. A similar set of resonators 146, 148, and 150 are shown in cavity 124. An end of coupling unit 128 is designated as 152 and may be referred to as a signal jack or signal termination device. A similar terminal 154 is provided for the end of coupling device 130.

Figure 4:
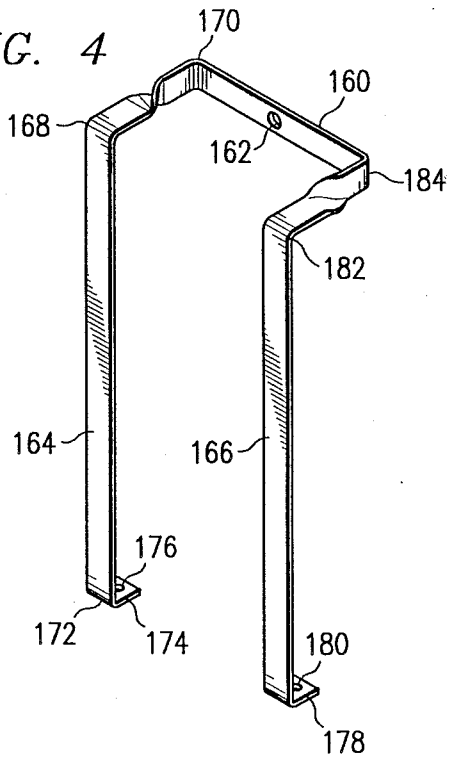
FIG. 4 is an isometric drawing of the diplexer element of the design utilized in FIG. 1.

In FIG. 4 the diplexer element is shown in the shape of a bent forked device where a common portion 160 has an opening 162 for applying signals to or receiving them from either or both of legs 164 and 166. Between leg 164 and common element 160, there is a first right angle bend 168 and a second right angle bend 170. Intermediate bends 168 and 170 the material has been distorted in a 90 degree twist to accommodate the shaping of the diplexer element. A further bend 172 is used between the leg 164 and a foot 174. Within foot 174 there is an attachment type opening 176. Leg 166 has a further associated foot 178 and an attachment opening 180. A right angle bend 182 is shown at the upper end of leg 166. A right angle bend 184 is shown at the near side of element 160. In between bends 182 and 184, a deforming 90 degree twist is shown similar to that shown between right angle bends 168 and 170.

OPERATION

A diplexer unit in one embodiment comprises a pair of comb-line filters. This can be used to send signals of two different frequencies to two different types of loads. In the drawing of FIG. 2, terminal labeling is provided for a situation where the diplexer is connected to a single antenna via the jack 110 so that the antenna can receive signals at one frequency from the receiver connected to the coupler 104 in cavity 84 and can send signals at a different frequency to the transmitter via cavity 82 and coupler 102.

Thus, the diplexer is merely a device for connecting a single electric circuit to two different circuits where the two different circuits, depending upon the circuit application, may receive only, transmit only, or both receive and transmit signals to be bandpass filtered by the diplexer device.

FIG. 1 shows more detail than do the more conceptual drawings of FIGS. 2 and 3, and has the added refinement of the reject elements such as 46 and 48. When the container 10 is fully assembled with the cover 20 in place, a signal may be applied to terminal 22 of a given frequency that comprises the desired bandpass of cavity 12. A volt meter or other signal strength measuring device is attached to jack 68. The leg 26 is then adjusted in position relative its closeness to the first adjacent resonating element to obtain a maximum signal strength indication at the signal measuring device. When the maximum is reached, the hardware comprising 32 and 34 is secured to prevent further movement of leg 26. Reflected power is typically utilized for final tuning. The capacity of the resonators such as 42 are then adjusted individually to even further increase the strength of the signal received at jack 68 and its connected signal measuring device. Another adjustment made to optimize the output signal is the position of coupling device 54 relative resonator 42. This adjustment is made by the attaching means 62 and 64. Typically, the aforementioned adjustments are repeated in an iterative process until no further increase in signal strength is obtained at terminal 68. The adjustment of the reject device 46 would typically be accomplished after the resonating elements in the other cavity had been tuned and the signal for that cavity is being applied to pin 22. Under these conditions, the resonant frequency of reject element 46 is tuned to minimize the output signal at some major frequency component outside the desired bandpass from appearing at jack 68. Likewise, reject element 48 would be tuned to minimize the output at jack 70 when the desired signal is being bandpassed between jack 68 and 22.

It should be noted that while the coupling devices 54 and 56 should be approximately one-quarter wavelength, they do not have to be exactly one-quarter wavelength. The same is true of the distance between the central point 24 of the diplexer coupling element 16 and the end of each leg such as leg 26. Further, the distance between the leg 26 and the resonator to which it is being coupled does not have to be the same throughout the length of the leg. The average distance will provide appropriate coupling for most applications. Further, while the resonator elements, such as 42, are near one-quarter the wavelength of the signal to be filtered, they are typically less than one-quarter wavelength and the effective electrical length is altered by the capacitance introduced between the threaded slug 50 extending upward from the bottom of the cavity 12 to a point near but not touching the resonator 42 to produce a capacitance to the container or other ground.

As previously indicated, there will be many instances where a diplexer does not have such critical requirements that reject elements such as 46 and 48 of FIG. 1 are required. Further, comb-line type filters can vary all the way from two resonator elements to a very large number depending upon the sharpness of bandpass filter specifications desired.

In view of the above comments, it is believed that the operation of the alternate container configurations and the associated adjustable coupling elements of FIGS. 2 and 3 will be apparent to anyone skilled in the art. The only reason for illustrating the other embodiments is to show that the common element in each case can be comprised of a very simple piece of material such as aluminum which can be easily bent or deformed to provide optimum coupling and to eliminate the multiple part approach of the prior art where separate components were required for the coupling element, the signal divider, signal transmission means and phase adjusting devices utilized. The total length of the common diplexer element is substantially equal to one-half wavelength as will be very apparent from FIG. 2 and from the center or common input output point such as 96 to the end of either leg would be typically identical and approximately one-quarter the wavelength of the two different frequencies to be bandpassed through the separate cavities such as 82 and 84 to the appropriate coupler outputs such as 102 and 104.

I wish to be limited not to the specific embodiments of a diplexer element as illustrated in the various figures, but only by the scope of the appended claims wherein I claim.

1. Diplexer type dual signal frequency bandpass filter apparatus comprising, in combination:

first and second microwave rectangular closed end conductive conduits each having a first and second orthogonal cross-sectional dimensions wherein the first dimension is substantially equal to one-quarter the wavelength of a frequency to be filtered;

a plurality of resonator elements, from first to N plus an interfering frequency reject resonator element, distributed along the length of each of said closed end conductive conduit means to form a comb-line type filter, said elements being substantially one-quarter wavelength long in mechanical dimensions and including capacitive adjustment means for adjusting the effective electrical length of said first to N elements to exactly one-quarter wavelength of the desired coupled frequency wherein the desired frequency in each of the two closed end conductive conduits is different;

adjustment slots in an electrically grounded wall of each of said first and second closed end conductive conduits adjacent a common end of said first and second closed end conductive conduits;

a diplexer coupling element, having a total length of substantially one-half wavelength, including a common central point and having the ends thereof extending through said adjustment slot means of said first and second closed end conductive conduits;

adjustable clamp means for electrically and mechanically attaching the ends of said diplexer coupling element to the wall of said closed end conductive conduit in a position which provides optimum coupling to the respective first resonator element;

remote coupling element means adjustably located intermediate said N and said reject resonators in each of said closed end conductive conduits whereby the distance between said coupling element and said N resonator element can be adjusted to provide optimum interaction;

a signal jack attached to each of said remote coupling element means; and signal jack means attached to said common central point of said diplexer coupling element for interchanging electrical signals of different frequencies between said diplexer apparatus and a single electrical circuit.

2. Diplexer type dual signal frequency bandpass filter apparatus comprising, in combination:

first and second juxtaposed microwave closed end conductive conduits;

a plurality of resonator elements and capacitive adjustments, from first to N, distributed along the length of each of said closed end conductive conduits to form a comb-line type filter, said elements being close enough to one-quarter wavelength long in mechanical dimensions whereby said capacitive adjustment means can be adjusted to effect an electrical length of said elements of exactly one-quarter wavelength of the desired coupled frequency wherein the desired frequency in each of the two closed end conductive conduits is different;

an adjustment slot in an electrically grounded portion of each of said first and second closed end conductive conduits adjacent a common end of said first and second closed end conductive conduits;

a diplexer coupling element, having a total length of substantially one-half wavelength, including a common central point and having the ends thereof extending through said adjustment slot of said first and second closed end conductive conduits;

adjustable clamp means for electrically and mechanically attaching the ends of said diplexer coupling element means to the wall of said closed end conductive conduit in a position which provides optimum coupling to the respective first resonator element;

a remote coupling element adjustably located near said N resonator in each of said closed end conductive conduits whereby the distance between said coupling element and said N resonator element can be adjusted to provide optimum interaction;

a signal jack attached to each of said remote coupling elements; and signal jack means attached to said common central point of said diplexer coupling element for interchanging electrical signals of different frequencies between said diplexer apparatus and a single electrical circuit.

3. Diplexer type dual signal frequency bandpass filter apparatus comprising, in combination:

first and second juxtaposed closed containers;

a plurality of resonator elements, from first to N, distributed along the length of each of said containers to form a comb-line type filter, said elements including capacitive adjustment means for adjusting the effective electrical length of said element to exactly one-quarter wavelength of the desired coupled frequency wherein the desired frequency in each of the two containers is different;

a adjustment opening in each of said first and second containers adjacent a common end of said first and second containers;

a diplexer coupling element, having a total length of substantially one-half wavelength, including a common central point and having the ends thereof extending through said adjustment opening of said first and second containers;

adjustable clamp means for mechanically attaching the ends of said diplexer coupling element to said container in a position relative said first resonator element which provides optimum coupling to the respective first resonator element;

remote coupling element means adjustably located near said N resonator in each of said containers whereby the average distance between said coupling element and said N resonator element can be adjusted to provide optimum interaction;

a signal jack attached to each of said remote coupling elements; and signal jack means attached to said common central point of said diplexer coupling element for interchanging electrical signals of different frequencies between said diplexer apparatus and a single electrical circuit.

4. Diplexer type dual signal frequency bandpass filter apparatus comprising, in combination:

first and second juxtaposed closed containers;

a plurality of resonator elements, from first to N, distributed along the length of each of said container to form a comb-line type filter, said elements including capacitive adjustment means for adjusting the effective electrical length of said elements to exactly one-quarter wavelength of the desired coupled frequency wherein the desired frequency in each of the two containers is different;

an adjustment opening in each of said first and second containers adjacent a common end of said first and second containers;

a diplexer coupling element, having a total length of substantially one-half wavelength, including a common central point and having the ends thereof extending through said adjustment opening of said first and second containers;

adjustable clamp means for mechanically attaching the ends of said diplexer coupling element to said containers in a position relative said first resonator element which provides optimum coupling to the respective first resonator element;

a remote coupling element and associated signal jack located near said N resonator in each of said containers; and signal jack means attached to said common central point of said diplexer coupling element for interchanging electrical signals of different frequencies between said diplexer apparatus and a single electrical circuit.

5. The method of optimally tuning a diplexer unit having two juxtaposed metallic container means each containing a plurality of resonant frequency adjustable resonator elements and a separate outside circuit coupling element arranged in the form of a comb-line filter comprising the steps of:

using a deformable common coupling element of a length substantially equal to one-half wavelength of the bandpass frequency of the comb-line filter with two legs at a point common to the juxtaposed container means, the ends of which legs are electrically grounded at any of a variety of positions to effect a distance variation between a given leg and an adjacent resonator element in each of the container means for optimizing the coupling therebetween; and attaching a signal jack at a point intermediate the ends of said deformable common coupling element for communicating electrical signals between the diplexer unit and the outside environment of two different frequencies in accordance with the tuning of the resonator elements in each of said container means.

6. The method of optimally tuning a diplexer unit having two juxtaposed container means each containing a plurality of electrical effective length adjustable resonator elements and a separate outside circuit coupling element arranged in the form of a comb-line filter comprising the steps of:

using a common coupling element of a length substantially equal to one-half wavelength of the bandpass frequency of the comb-line filter with two legs at a point common to the juxtaposed container means, the ends of which legs are securely positioned relative an adjacent resonator element at any of a variety of positions to effect an average distance between the leg and its adjacent resonator element in each of the container means for optimizing the coupling therebetween; and attaching a signal jack at a point intermediate the ends of said deformable common coupling element for communicating electrical signals between the diplexer unit and the outside environment of two different frequency in accordance with the tuning of the resonator elements in each of said container means.

* * * * *